US006595814B2

(12) United States Patent
Hartke et al.

(10) Patent No.: US 6,595,814 B2
(45) Date of Patent: Jul. 22, 2003

(54) WATERCRAFT FUEL SUPPLY APPARATUS AND METHOD

(75) Inventors: David J. Hartke, Gurnee, IL (US); Richard P. Kolb, Prairieview, IL (US)

(73) Assignee: Bombardier Motor Corporation of America, Grant, FL (US)

( * ) Notice: Subject to any disclaimer, the term of this patent is extended or adjusted under 35 U.S.C. 154(b) by 0 days.

(21) Appl. No.: 10/000,176

(22) Filed: Oct. 23, 2001

(65) Prior Publication Data

US 2002/0072280 A1 Jun. 13, 2002

Related U.S. Application Data

(63) Continuation of application No. 09/620,457, filed on Jul. 21, 2000, now Pat. No. 6,379,200.

(51) Int. Cl.[7] ..... B63H 21/10
(52) U.S. Cl. ..... 440/88 F
(58) Field of Search ..... 440/88, 89; 137/588, 137/565.34; 123/509, 514, 510, 541; 220/4.14; 280/834

(56) References Cited

U.S. PATENT DOCUMENTS

| | | | | |
|---|---|---|---|---|
| 2,936,781 A | | 5/1960 | Caen | |
| 2,939,476 A | | 6/1960 | Absolon | |
| 3,073,333 A | | 1/1963 | Cherrington | |
| 4,113,138 A | | 9/1978 | Fields et al. | |
| 4,168,012 A | | 9/1979 | Hawkinson | |
| 4,306,844 A | * | 12/1981 | Otto et al. | 417/424 |
| 4,327,770 A | | 5/1982 | Brown et al. | |
| 4,590,964 A | * | 5/1986 | Beardmore | 137/565 |
| 4,653,552 A | | 3/1987 | Friedle | |
| 4,671,773 A | | 6/1987 | Friedle | |
| 4,722,708 A | | 2/1988 | Baltz | |
| 4,809,666 A | | 3/1989 | Baltz | |
| 4,880,403 A | | 11/1989 | Friedle et al. | |
| 4,952,347 A | | 8/1990 | Kasugai | |
| 5,056,492 A | * | 10/1991 | Banse | 123/509 |
| 5,137,480 A | | 8/1992 | Binversie et al. | |
| 5,275,213 A | | 1/1994 | Perkins | |
| 5,297,578 A | | 3/1994 | Scott et al. | |
| 5,327,946 A | | 7/1994 | Perkins | |
| 5,409,035 A | | 4/1995 | Scott et al. | |
| 5,704,337 A | | 1/1998 | Strätz et al. | |
| 5,928,745 A | | 7/1999 | Wood et al. | |
| 6,182,693 B1 | * | 2/2001 | Stack et al. | 137/565.17 |
| 6,379,200 B1 | * | 4/2002 | Hartke et al. | 440/88 |

* cited by examiner

*Primary Examiner*—Ed Swinehart
(74) *Attorney, Agent, or Firm*—Ziolkowski Patent Solutions Group, LLC

(57) ABSTRACT

A fuel storage and supply apparatus (22) for a watercraft (10) incorporating a plurality of connections (50,66) penetrating a housing (32) in a single opening in a fuel tank (12). Each connection is sealed by a radial O-ring (56,68) so that the connection may be rotated about a longitudinal axis without adversely affecting the seal. A single opening (34) in the tank may thereby be used to provide connections for a fill tube (66), fuel tube (50), vent (86), and electrical penetrations (150) for an in-tank pump (136) or level sensor (156).

37 Claims, 5 Drawing Sheets

WATERCRAFT FUEL SUPPLY APPARATUS AND METHOD

This application is a continuation of Ser. No. 09/620,457, filed Jul. 21, 2000, now U.S. Pat. No. 6,379,200.

BACKGROUND OF THE INVENTION

The present invention relates generally to fuel supply systems, and more particularly to a fuel supply system for a watercraft, and in particular, to a fuel tank having a plurality of sealed, rotatable connections formed through a single opening in the tank.

Present marine fuel storage and distribution systems typically include a fuel tank, a fuel conduit connected between an engine and the fuel tank, a pump for conveying fuel through the conduit, a priming pump, one or more filters for removing sediment and water from the fuel prior to its delivery to the engine, fill and vent tubes connected to the tank, a cap for the fill tube that may provide the venting function when installed, and instrumentation for providing a signal corresponding to the level of fuel within the tank. One or more of these components may be duplicated in watercraft having more than one engine, or for the purpose of improved capacity, flexibility or reliability.

It is known that each joint or connection in a fuel system is a point for potential leakage of liquid fuel and/or vapors. It is therefore desirable to minimize the number of connections within a fuel system. In particular, it is desirable to minimize the number of connection to a fuel tank, since the tank is an expensive component to fabricate and is often installed in a location that is not accessible for repair activities. Furthermore, since the tank provides the primary boundary for the containment of the fuel, it is desirable to make the tank as fail-safe as possible.

It is also known that the space requirements and layout of a fuel system are important parameters in the design of a watercraft. The location, number and capacity of fuel tanks and the layout of fuel and vent lines may not be known until the power unit(s) for the boat are selected. Accessibility for routine maintenance and servicing must also be considered when designing a marine craft fuel system.

BRIEF SUMMARY OF THE INVENTION

Thus there is a particular need for a fuel system for a watercraft that provides a high degree of flexibility for the marine designer. Such a fuel system should minimize the number of connections, and in particular, should minimize the number of penetrations into the fuel tank.

Accordingly, a fuel storage and supply apparatus for a watercraft is described herein as including: a fuel tank having an opening formed therein; a housing sealingly attached to the fuel tank within the opening, the housing having an opening formed therethrough; a tube disposed through the housing opening and longitudinally rotatable therewithin; and a radial O-ring seal disposed between a wall of the opening and an outside surface of the tube.

The tube of the watercraft fuel storage and supply apparatus is further described as including: a groove formed in the outside diameter surface of the tube for receiving and retaining the radial O-ring seal; a flange formed on the outside surface of the tube, the flange having a diameter greater than the diameter of the housing opening and having a bottom surface disposed against a top surface of the housing; and a clamping plate removably attached to the housing and covering at least a portion of the flange for retaining the tube within the housing opening.

The watercraft fuel storage and supply apparatus may further include: a valve cavity formed within the housing and in fluid communication between the interior and exterior of the tank; a check valve disposed within the valve cavity; a fuel outlet nozzle rotatably disposed within the valve cavity; and a radial O-ring seal disposed between the fuel outlet nozzle and a wall of the valve cavity. The check valve may include: a plate disposed within the valve cavity and sealed thereto about its perimeter; a hole formed in the plate for the passage of fuel therethrough; and an elastomer attached to the plate and extending therefrom to cover the hole, the elastomer operable to bend to permit fuel to pass out of the tank through the hole, and operable to seal the hole in the event of the flow of fuel into the tank.

BRIEF DESCRIPTION OF THE DRAWINGS

The features and advantages of the present invention will become apparent from the following detailed description of the invention when read with the accompanying drawings in which.

Similar structures illustrated in multiple figures may be designated by the same numeral in multiple figures.

DETAILED DESCRIPTION OF THE INVENTION

Figure 1:
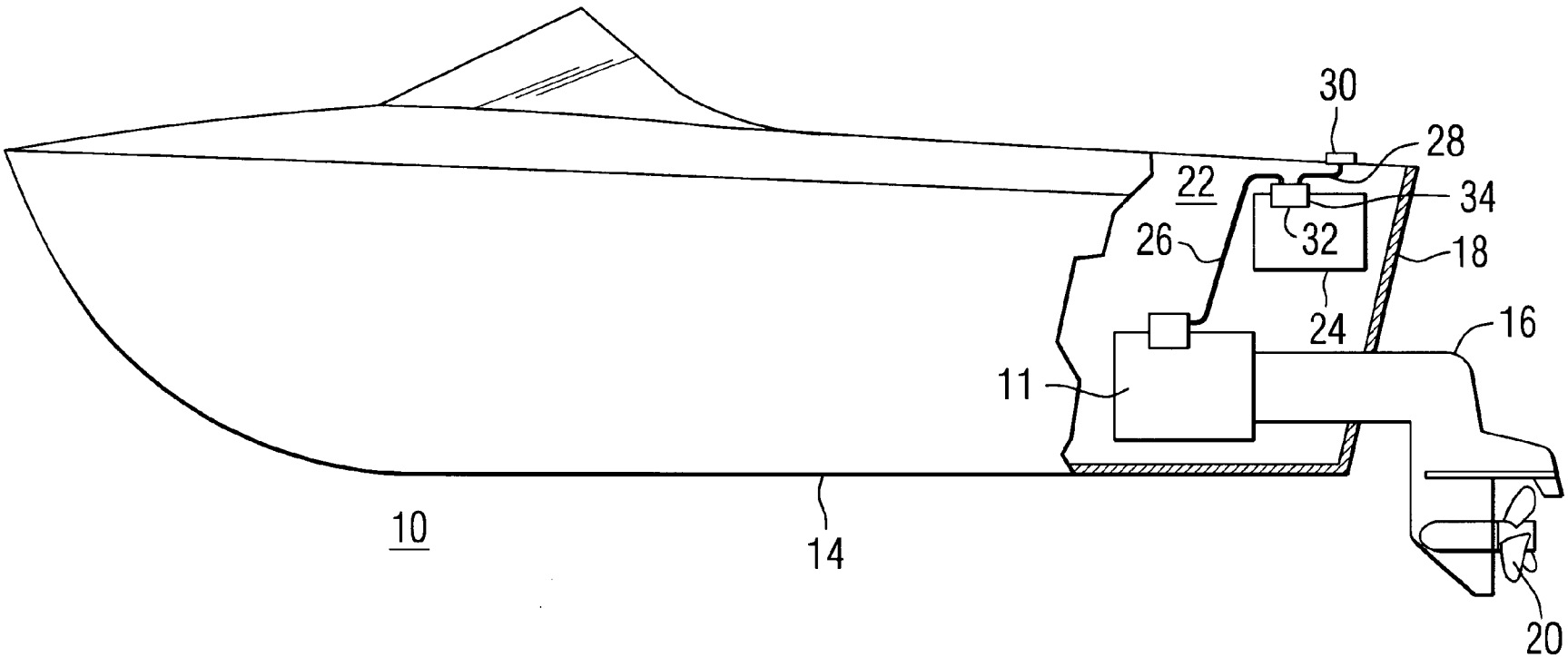
FIG. 1 is a schematic illustration of a boat having a motor and a fuel storage and supply apparatus.

FIG. 1 illustrates a watercraft 10 having an internal combustion engine 11 mounted in the interior of a boat hull 14. A power unit drive train 16 extends through the transom 18 of the watercraft 10 to deliver power to a propeller 20. This illustration can be recognized as representing the inboard/outboard style pleasure craft common in the watercraft industry, but one may appreciate that the apparatus described herein may be applied to any style of marine propulsion system, including inboard and outboard units. A fuel storage and supply apparatus 22 provides fuel (not shown) to engine 11. The fuel storage and supply apparatus 22 includes a tank 24, fuel supply lines 26, a fuel fill tube 28, and a fill tube cap 30. The fuel lines 26 and fuel fill tube 28 are supported in a housing 32 mounted in a single opening 34 formed in a tank 24.

Figure 2:
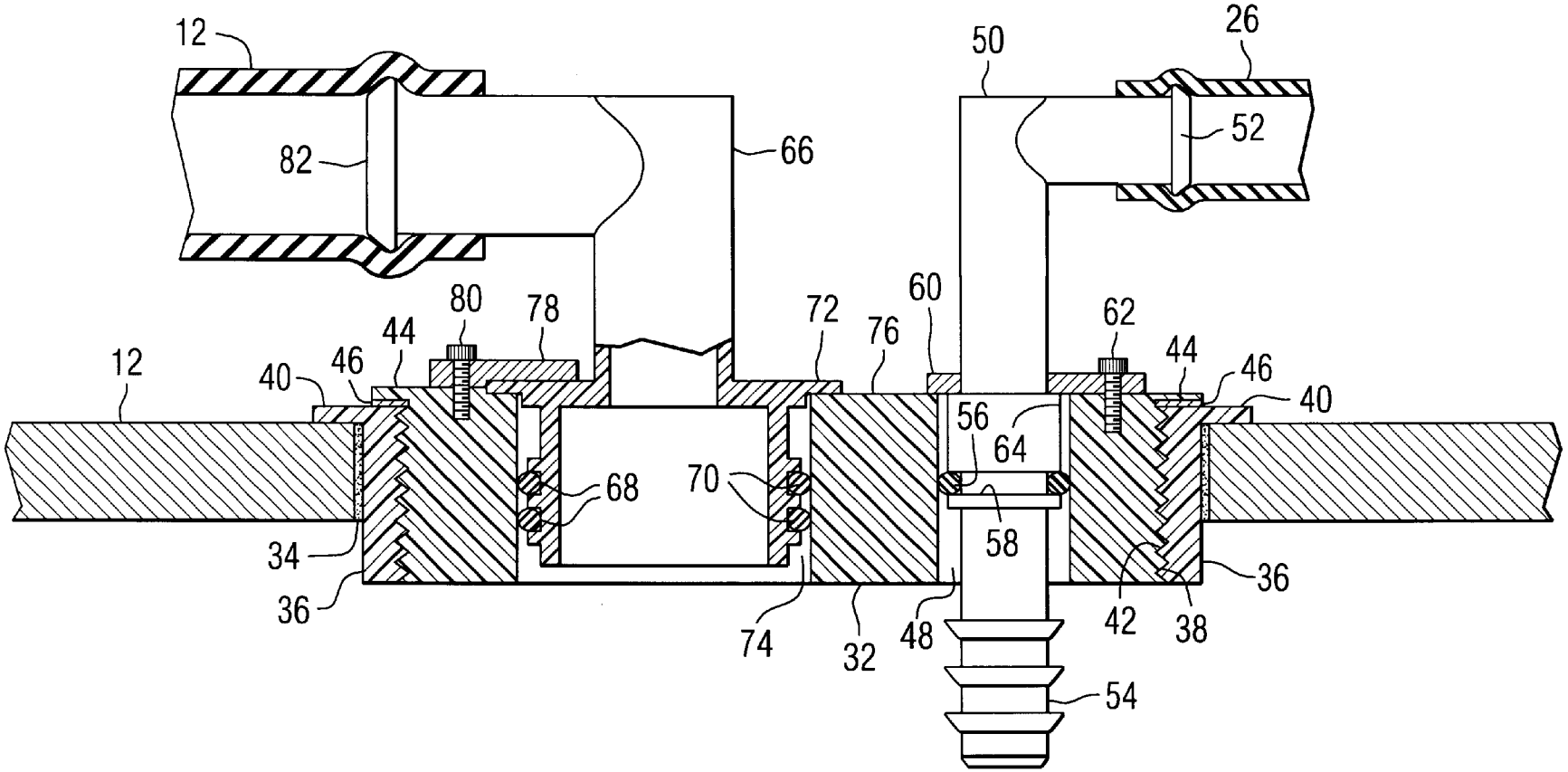
FIG. 2 is a partial section view of a portion of the fuel tank of FIG. 1 illustrating the single opening in the tank and rotatable fuel fill and delivery tubes sealed with radial O-ring seals installed into a housing in the opening.

FIG. 2 is a more detailed illustration of a portion of the fuel storage and supply apparatus 22 of FIG. 1. Housing 32 can be seen disposed within the single opening 34 of tank 12. Housing 32 is illustrated as being threaded into an adapter 36 which, in turn, is fixedly attached to tank 12 within opening 34. In one embodiment, tank 12 is formed by a blow molding process, wherein opening 34 is formed at the location of the blow pin used during the molding process. Adapter 36 includes precision dimensioned threads 38 formed along its inside diameter, and a flange surface 40 adapted to span the somewhat irregularly shaped opening 34. Adapter 36 may be sealed to tank 12 by any process known in the art, such as by welding for the embodiment of a polyethylene blow molded tank 12. Adapter 36 has formed on its exterior perimeter a series of threads 42 formed to mate with threads 38 of adapter 36. Housing 32 may thereby be screwed into adapter 36 until its flange 44 abuts the upper surface of adapter flange 40. A seal or gasket 46 may be disposed between the mating surfaces of adapter 36 and housing 32. In this manner, housing 32 is sealingly and removably attached to the fuel tank 12 within the opening 34.

Housing 32 may be formed to include any number of penetrations into the interior of tank 12. In the embodiment illustrated in FIG. 2, housing 32 functions to support both fuel line 26 and fill tube 28. Housing 32 includes an opening 48 formed therethrough for the passage of fuel tube 50. The outlet 52 of fuel tube 50 is attached to fuel line 26 by any attachment scheme known in the art. An inlet end 54 of fuel tube 50 extends into the interior of tank 12 for attachment to a fuel tube extension (not shown) operable to draw fuel from proximate the bottom of tank 12. Fuel tube 50 is sealed to housing 32 by a radial O-ring seal 56. O-ring 56 may be any material known in the art to be functional in such an application, such as a rubber or fluorocarbon material. O-ring 56 is retained in position around the exterior of fuel tube 50 by being partially disposed within a groove 58 formed in the exterior surface of fuel tube 50. The dimensions of the exterior of fuel tube 50, the interior of opening 48, and O-ring 56 are selected such that the O-ring provides an appropriate pressure seal against the leakage of fuel through the opening 48 around the exterior of fuel tube 50. In most applications, the differential pressure across O-ring seal 56 will be no more than 10–15 psi, which is well within the design pressures of known radial O-ring seal designs. Advantageously, O-ring seal 56 permits fuel tube 50 to be rotated about its longitudinal axis within opening 48 without any degradation of the sealing function, thereby allowing the outlet 52 to be directed to any radial position. To restrain fuel tube 50 from vertical movement out of opening 48, a locking plate 60 is secured by a fastener 62 to the housing 32 in order to restrain the vertical movement of flange 64 formed on the outside surface of fuel tube 50.

Fill tube 66 is supported in housing 32 in a manner very similar to that of fuel tube 50. A plurality of grooves 68 are formed on the outside diameter surface of tube 66 for receiving and retaining a plurality of parallel radial O-rings 70. A flange 72 is formed on the outside diameter surface of tube 66 to have a diameter greater than the diameter of the opening 74 in which tube 66 is disposed. A bottom surface of flange 72 is held against a top surface 76 of housing 32 by clamping plate 78. Clamping plate 78 is, in turn, held in position by fastener 80 threaded into the body of housing 32. Clamping plate 78 covers at least a portion of flange 72 for removably retaining the tube 66 within the opening 74 of housing 32. Fill tube 66 may be rotated about it longitudinal axis to position its outlet 82 in any of a plurality of radial positions without affecting the functionality of the radial O-ring seal 70.

Figure 3:
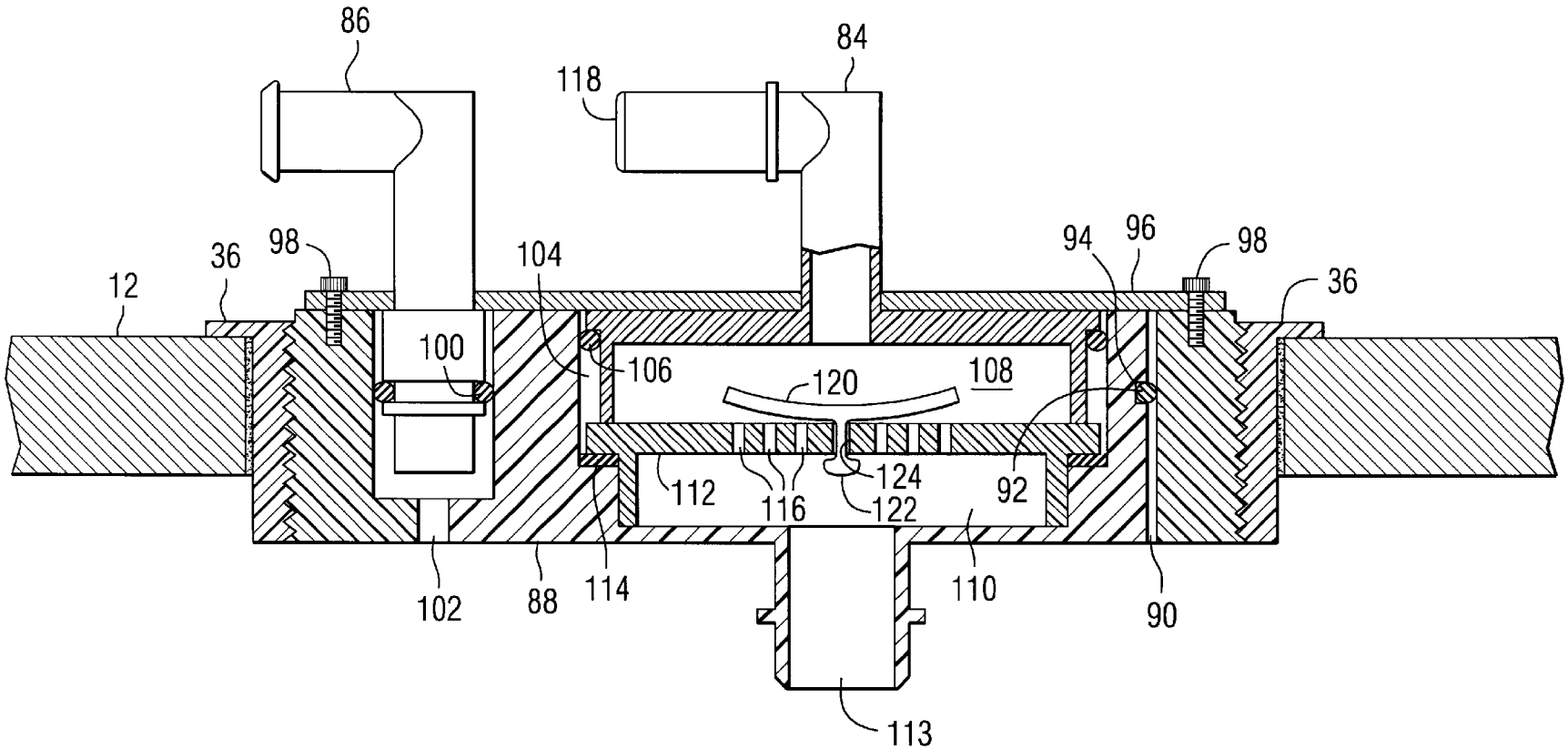
FIG. 3 is a partial sectional view of an anti-siphon check valve built into a rotatable fuel fill tube sealed with a radial O-ring in a housing in the opening of a fuel tank.

FIG. 3 is a partial sectional illustration of an embodiment wherein both a fuel supply tube 84 and a vent tube 86 are rotatably mounted within a housing 88 which, in turn, is rotatably sealed within an opening 90 formed in the tank 12. Radial O-ring 92 is disposed within a notch 94 formed in an exterior surface of housing 88 to provide the pressure seal against tank opening 90. Cover plate 96 prevents the vertical movement of housing 88 and is removably attached to tank 12 by fasteners 98. Vent tube 86 is rotatably sealed by O-ring 100 within vent opening 102 formed in housing 88. Fuel supply tube 84 is rotatably sealed within fuel supply opening 104 by radial O-ring 106. An anti-siphon check valve assembly 108 is formed to be integral to the housing 88. A valve chamber 110 is formed in housing 88 and is in fluid communication with the fuel supply tube 84 and fuel inlet 112. Check valve assembly 108 is disposed within the valve cavity 110 and includes a plate 112 sealed to housing 88 about its perimeter by gasket 114. A plurality of holes 116 are formed in plate 112 to permit the passage of fuel from inlet 113 to fuel tube outlet 118. An elastomeric disk 120 is attached to the plate 112, such as by extending tang 122 through an opening 124 of plate 112. Elastomeric disk 120 extends from the point of attachment to cover holes 116 along the upper surface of plate 112. In this manner, elastomeric disk 120 is operable to bend upward to permit the flow of fuel out of tank 12 through inlet 112 and valve cavity 110 to outlet 118 of fuel tube 84. However, in the event of any reverse flow through fuel tube 84, elastomeric disk 120 is operable to be forced downward against the tope of plate 112, thereby covering holes 116 and terminating any such reverse flow. Elastomeric disk 120 may be any material known in the art and suitable for such an application, such as for example, rubber. Other styles of valves may be used, such as a spring loaded poppet valve having a predetermined opening pressure. Housing 88 and tubes 84, 86 may be manufactured from any material compatible with the fuel to be used, and may preferably be a machinable plastic or injection molded material. As with previous embodiments, fuel supply tube 84 and vent tube 86 may be rotated about their respective longitudinal axes to position their respective outlets to any radial position without affecting the sealing function provided by O-rings 100, 106. Furthermore, the entire housing 88 may be rotated about a longitudinal axis without affecting the sealing function provided by O-ring 92.

Figure 4:
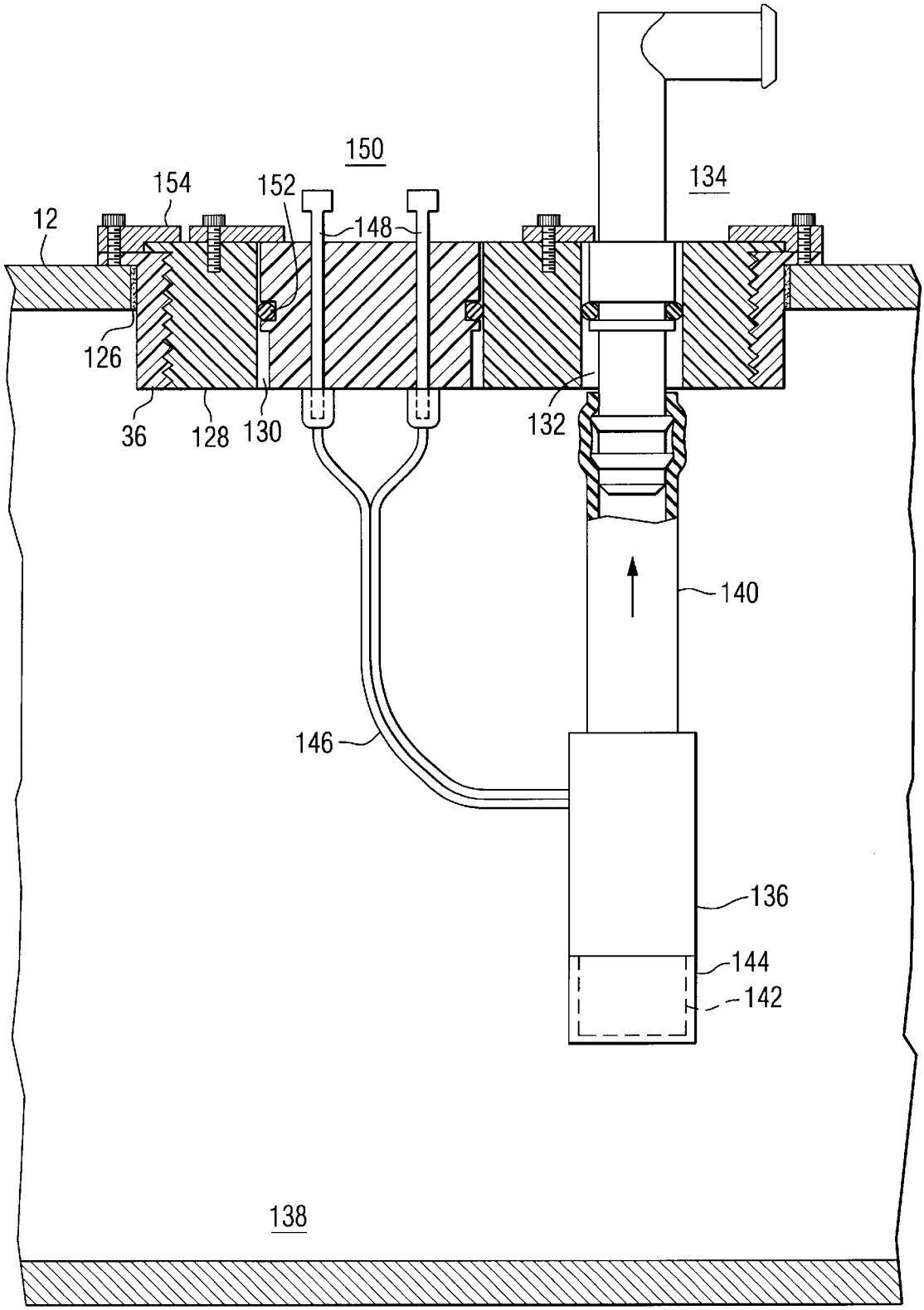
FIG. 4 is a partial section view of a fuel tank having a single opening and an in-tank fuel pump and filter. The fuel outlet of the pump is directed to a rotatable fuel tube sealed with a radial O-ring seal into a housing in the opening. The housing also includes an electrical penetration operable to deliver electrical energy to the pump motor.

FIG. 4 is a partial cross-sectional illustration of another embodiment of a fuel tank 12 having an opening 126 formed therein, with a housing 128 disposed within opening 126 and containing a plurality of openings 130, 132 for the installation of various components of the fuel storage and supply apparatus. A fuel tube assembly 134 may be rotatably installed within opening 132 in a manner similar to that described above. In this embodiment, a one-piece fuel pump assembly 136 including a pump and a motor apparatus is disposed within the interior of the tank 12 proximate the bottom 138 of the tank 12. A fuel line 140 is connected between an outlet of pump 136 and fuel tube assembly 134. A replaceable fuel filter 142 is disposed within a fuel filter housing 144 attached at the inlet of pump 136. In an alternate embodiment wherein no fuel pump and motor apparatus is installed within the tank 12, the fuel filter 142 and housing 144 may be installed directly to the fuel line 140. Electricity for pump 136 is provided via electrical lines 146 connected to the pins 148 of an electrical penetration assembly 150 disposed within opening 130 of housing 128. Electrical penetration assembly 150 is rotatably sealed within opening 130 by radial O-ring seal 152. It may be appreciated that the pump/motor 136 and filter assembly 144 may be preassembled onto housing 128 prior to its installation within opening 126 of tank 12. The replacement of filter 142 may then be simply accomplished by the removal of cover plate 154 and housing 128 from tank 12.

Figure 5:
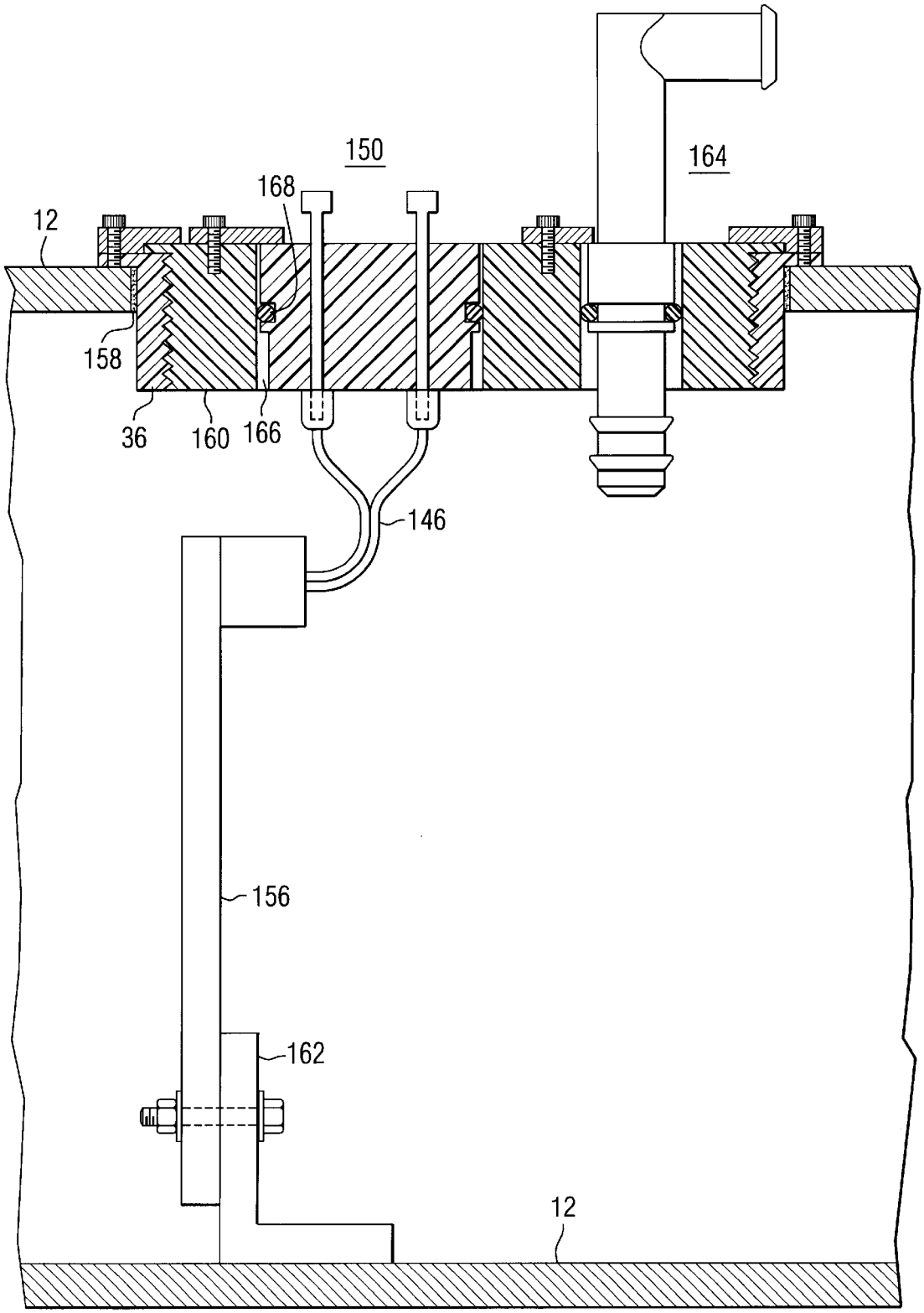
FIG. 5 is a partial section view of a fuel tank having a single opening and an in-tank fuel level sensor. Electrical connections to the sensor are made via an electrical penetration mounted to a housing in the opening. The housing also supports a rotatable fuel outlet tube sealed to the housing by a radial O-ring seal.

FIG. 5 illustrates an embodiment of tank 12 having an internally mounted fluid level sensor 156 disposed proximate an opening 158 in tank 12. A housing 160 is rotatably sealed within opening 158, and is removable to provide access to sensor 156. Sensor 156 may be attached to tank 12 by a bracket 162 accessible through opening 158. Electrical penetration assembly 150, as previously described with respect to FIG. 4, provides power and/or signal connections for sensor 156. Housing 162 may include one or more other openings for appropriate fluid, electrical, or mechanical penetrations, such as fuel line assembly 164. Electrical penetration assembly 150 may be retained within opening 166 by the friction of O-ring 168 against the walls of opening 166, or an additional mechanical means of retention (not shown) may be provided. In this embodiment, as with those described above, the use of a radial O-ring seal apparatus facilitates the rotational movement of the various fuel tank penetrations within housing 160 without adversely affecting the seal provided therebetween.

It may be appreciated that fuel storage and supply apparatus 22 of FIG. 1 containing one or more of the features illustrated in FIGS. 2 through 5 provides the designer of a watercraft 10 with improved flexibility of design when compared to prior art fuel storage and supply apparatus. For example, it is not uncommon for a manufacturer to design and to sell a watercraft that is complete in ever respect except for the selection of the power unit. A fuel tank may be supplied with the boat, however, the connections between the power unit and the fuel tank will remain incomplete until the power unit is later specified. Changes in the tank connections and routing of the fuel system lines is made more difficult by the fixed connections found on prior art fuel tanks. By using a housing having multiple penetrations with individually rotatable connections, a variety of optional power units may be accommodated into a previously installed tank assembly. Similarly, a single tank may be stocked for a variety of applications, with each application being accommodated by the use of a specifically selected housing assembly installed within a single standardized opening of the tank. Furthermore, the installation and maintenance of a watercraft fuel system may be simplified by the ability to rotate various connections to a fuel tank without adversely affecting the effectiveness of the fluid seal for those connections.

Thus, a method of assembling a watercraft may include the steps of providing a hull; providing a fuel tank having an opening formed therein; installing the fuel tank in the hull; assembling a power unit to the hull; selecting a fuel tank opening housing having connections corresponding to the power unit; installing the fuel tank opening housing into the fuel tank opening; and installing a fuel line between the housing and the power unit. This is especially useful if the manufacturer provides at least two different customer-specified power units for use in a watercraft, and the power units each require different fuel tank connections. By providing a plurality of corresponding tank opening housings, each fuel tank opening housing having connections corresponding to a respective one of the power units, the appropriate connections can be more easily installed after the tank is in place by simply installing the appropriate tank opening housing. Installation is further simplified by the ability to rotate the penetrations passing through the housing without adversely affecting the effectiveness of the O-ring seal.

It may be further appreciated that the use of a single housing having a plurality of rotatable connections will provide a simplified method and apparatus for the modification of the fuel storage and supply system of a watercraft. This may occur, for example, in the event that a pressurized fuel system is approved for use on a watercraft that had previously utilized a suction fuel system. A modification kit may be assembled including an in-tank pump and an appropriate housing assembly having multiple fuel supply, vent fill, and electrical connections, as appropriate.

While the preferred embodiments of the present invention have been shown and described herein, it will be obvious that such embodiments are provided by way of example only. Numerous variations, changes and substitutions will occur to those of skill in the art without departing from the invention herein. Accordingly, it is intended that the invention be limited only by the spirit and scope of the appended claims.

We claim as our invention:

1. A watercraft fuel storage and supply apparatus comprising:

a fuel tank having an opening formed therein;

a housing attached to the fuel tank within the opening, the housing having a pair of openings formed therethrough;

a pair of tubes, each disposal through a respective housing opening and rotatable therewithin, each tube secured to the housing independently by a respective mounting bracket; and a seal disposed between each opening and a respective tube.

2. The watercraft fuel storage and supply apparatus of claim 1, further comprising:

a fuel line attached to the tube and extending to a bottom portion of the tank; and a replaceable fuel filter attached to the fuel line.

3. The watercraft fuel storage and supply apparatus of claim 1 wherein the housing is attached to the fuel tank by a threaded connection.

4. The watercraft fuel storage and supply apparatus of claim 1, wherein the tube further comprises:

a groove formed in the outside diameter surface of the tube for receiving and retaining a radial O-ring seal;

a flange formed in the outside surface of the tube, the flange having a diameter greater than the diameter of the housing opening and having a bottom surface disposed against a top surface of the housing; and a clamping plate removably attached to the housing and covering at least a portion of the flange for retaining the tube within the housing opening.

5. The watercraft fuel storage and supply apparatus of claim 1, further comprising:

a valve cavity formed within the housing and in fluid communication between the interior and exterior of the tank;

a check valve disposed within the valve cavity;

a fuel outlet nozzle rotatably disposed within the valve cavity; and a radial O-ring seal disposed between the fuel outlet nozzle and a wall of the valve cavity.

6. The watercraft fuel storage and supply apparatus of claim 5, wherein the check valve further comprises:

a plate disposed within the valve cavity and sealed thereto about its perimeter;

a hole formed in the plate for the passage of fuel therethrough; and an elastomer attached to the plate and extending therefrom to cover the hole, the elastomer operable to bend to permit fuel to pass out of the tank through the hole, and operable to seal the hole in the event of the flow of fuel into the tank.

7. The watercraft fuel storage and supply apparatus of claim 1, further comprising:

a further opening formed through the housing; and an electrical penetration sealingly disposed within the further opening.

8. The watercraft fuel storage and supply apparatus of claim 7, further comprising:

a pump assembly disposed within the tank and having an outlet connected to the tube;

a wire connected between the pump assembly and the electrical penetration for supplying electrical power to the pump assembly.

9. The watercraft fuel storage and supply apparatus of claim 8, further comprising a filter attached to an inlet of the pump assembly.

10. The watercraft fuel storage and supply apparatus of claim 7, further comprising:

a fluid level sensor disposed within the tank; and a wire connected between the fluid level sensor and the electrical penetration.

11. A fuel storage and supply apparatus comprising:

a tank having an opening formed therein;

a housing sealingly disposal within the tank opening;

a fill opening formed in the housing;

a fill tube rotatably disposal within the fill opening;

a seal disposed between the fill rube and the fill opening;

a fuel supply opening formed in the housing;

a fuel supply tube rotatably disposed within the fuel supply opening to allow rotation thereof past the fill tube; and a seal disposed generally between the fuel supply tube and a surface of the fuel supply opening.

12. The fuel storage and supply apparatus of claim 11, further comprising a check valve disposed within the fuel supply opening.

13. The fuel storage and supply apparatus of claim 12, wherein the check valve further comprises:

a plate having a plurality of holes formed therein for the passage of fuel disposed in the fuel supply opening and sealed thereto along its perimeter;

an elastomeric disc attached to the plate and extending to cover the outlet ends of the plurality of holes; and the elastomeric disc operable to bend to permit fuel to pass out of the tank through the plurality of holes, and operable to seal the plurality of holes in the event of the flow of fuel into the tank.

14. The fuel storage and supply apparatus of claim 12, further comprising:

a third opening formed in the housing;

an electrical penetration disposed with the third opening; and a radial O-ring sealingly disposed between the electrical penetration and a surface of the third opening.

15. The fuel storage and supply apparatus of claim 11 wherein the fill tube and the fuel supply tube are positionable with respect to one another such that each tube may face a common direction along a common axis.

16. An apparatus for sealing an opening formed in a fuel tank, the apparatus comprising:

a housing operable to be sealing disposed within an opening formed in a fuel tank;

an opening formed through the housing;

a tube rotatably disposed through the housing opening; and only one radial seal disposed between the housing opening and the tube, such that the only one radial seal permits rotation of the tube relative thereto.

17. The apparatus of claim 16, further comprising:

a second opening formed through the housing;

a second tube disposed to pass through the second opening; and a radial O-ring sealingly disposed between the second opening and the second tube.

18. The apparatus of claim 16, further comprising:

a second opening formed through the housing;

an electrical penetration disposed to pass through the second opening; and a radial O-ring sealingly disposed between the second opening and the electrical penetration.

19. The apparatus of claim 16, further comprising a check valve sealingly disposed within the housing opening.

20. The apparatus of claim 16, further comprising:

a fuel line having a first end connected to the tube; and a filter connected to a second end of the fuel line.

21. The apparatus of claim 20, further comprising a pump assembly connected between the filter and the fuel line.

22. A kit comprising:

a housing adapted to be sealingly disposed within an opening formed in a fuel tank, the housing having an opening formed therethrough;

a tube adapted to be disposed through the housing opening; and a seal adapted to be disposed around the tube and between the tube and the wall or the housing opening for forming a sealed condition therebetween, such that the seal permits rotation of the tube relative thereto.

23. The kit of claim 22, further comprising:

a fuel line adapted to have a first end attached to the tube; and a filter adapted to be attached to a second end of the fuel line.

24. The kit of claim 22, further comprising:

the housing having a second opening formed therethrough;

an electrical penetration adapted to be disposed through the second housing opening; and an O-ring adapted to be disposed around the electrical penetration and between the electrical penetration and the wall of the second housing opening for forming a seal therebetween.

25. The kit of claim 24, further comprising:

a pump assembly adapted to have its outlet attached to the tube; and a wire connected between the electrical penetration and the pump assembly.

26. A watercraft comprising:

a hull;

a power unit attached to the hull;

a fuel tank disposed in the hull, the fuel tank having an opening formed therein;

a housing sealingly disposed in the tank opening, the housing having an opening formed therethrough;

a fuel tube rotatably disposed through the housing opening to allow rotation past another fuel tube disposed through the housing;

a seal disposed between the fuel tube and a wall of the housing opening; and a fuel line connected between the fuel tube and the power unit.

27. The watercraft of claim 26, further comprising:

a second opening formed through the housing;

an electrical penetration sealingly disposed through the second opening;

a pump disposed within the fuel tank and having an outlet connected to the fuel tube; and a wire connected between the pump and the electrical penetration.

28. The watercraft of claim 27, further comprising a fuel filter attached to an inlet of the pump.

29. The watercraft of claim 26, further comprising a filter disposed within the tank and connected to the tube opposed the fuel line.

30. The watercraft of claim 26, wherein the housing is in threaded engagement with the tank.

31. A watercraft fuel storage and supply apparatus comprising:

a fuel tank having an opening formed therein;

a housing positioned in the opening, the housing having a number of portholes;

a number of rotatable penetrations positioned in the number of portholes and configured to provide fuel passage between an exterior and an interior of the fuel tank wherein each penetration is rotatable 360°; and a number of seals configured to seal the number of rotatable penetrations to the housing.

32. The watercraft fuel storage and supply apparatus of claim 31 wherein the number of rotatable penetrations include at least one of a fuel line, a fill tube, a fuel supply tube, a vent tube, a fuel pump assembly, and an electrical penetration assembly.

33. The watercraft fuel storage and supply apparatus of claim 31 wherein the number of seals include O-rings.

34. The watercraft fuel storage and supply apparatus of claim 33 wherein an O-ring is radially disposed generally between a penetration and a surface of a porthole.

35. The watercraft fuel storage and supply apparatus of claim 31 wherein one of the penetrations includes a fuel line extending to a lower portion of the fuel tank, the fuel line having a replaceable filter attached thereto.

36. The watercraft fuel storage and supply apparatus of claim 33 wherein the O-ring is configured to permit rotation of a rotatable penetration about a longitudinal axis without comprising a sealed condition between the interior and the exterior of the fuel tank.

37. The watercraft fuel storage and supply apparatus of claim 31 wherein each of the number of penetrations further comprises a locking apparatus configured to couple a penetration to the housing, the coupling restricting vertical movement of the penetration.

* * * * *